US006254016B1

(12) United States Patent
Chao

(10) Patent No.: US 6,254,016 B1
(45) Date of Patent: Jul. 3, 2001

(54) WATER PISTOL NOZZLE

(76) Inventor: Hui-Chen Chao, 75, Liau Tsuo Hsiang, Liau Tsuo Li Lu Kang Chen, Chan Hua Hsien (TW)

( * ) Notice: Subject to any disclaimer, the term of this patent is extended or adjusted under 35 U.S.C. 154(b) by 0 days.

(21) Appl. No.: 09/638,000

(22) Filed: Aug. 15, 2000

(51) Int. Cl.[7] ..... B05B 7/02
(52) U.S. Cl. ..... 239/526; 239/600; 285/361
(58) Field of Search ..... 239/525, 526, 239/600; 285/361, 396, 402

(56) References Cited

U.S. PATENT DOCUMENTS 5,566,886 * 10/1996 Wang ..... 239/526
6,007,003 * 12/1999 Wang ..... 239/525

* cited by examiner

*Primary Examiner*—Lisa Ann Douglas
(74) *Attorney, Agent, or Firm*—Harrison & Egbert

(57) ABSTRACT

A water pistol nozzle including a handle and one or more nozzles detachably fastened to the handle. The handle is provided at one end with a first engagement portion which is provided with a retaining slot, a guide opening, and a washer. The nozzles are provided at one end with a second engagement portion which is provided with a retaining protrusion and a washer. The nozzles are detachably fastened to the handle such that the retaining protrusion of the nozzles is removably received in the retaining slot of the handle.

1 Claim, 8 Drawing Sheets

WATER PISTOL NOZZLE

BACKGROUND OF THE INVENTION

1. Field of the Invention

The present invention relates generally to a water sprinkling device, and more particularly to a water pistol nozzle.

2. Description of Related Art

The conventional water pistol nozzle is generally composed of a nozzle and a handle to which the nozzle is detachably fastened. The conventional water pistol nozzle is generally defective in design because the nozzle cannot be unfastened from the handle with ease and speed so as to facilitate the fastening of the handle to the nozzles of various forms.

BRIEF SUMMARY OF THE INVENTION

The primary objective of the present invention is to provide a water pistol nozzle comprising a handle and a nozzle, which are provided with means to facilitate the fast fastening and the fast unfastening of the handle from the nozzle.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
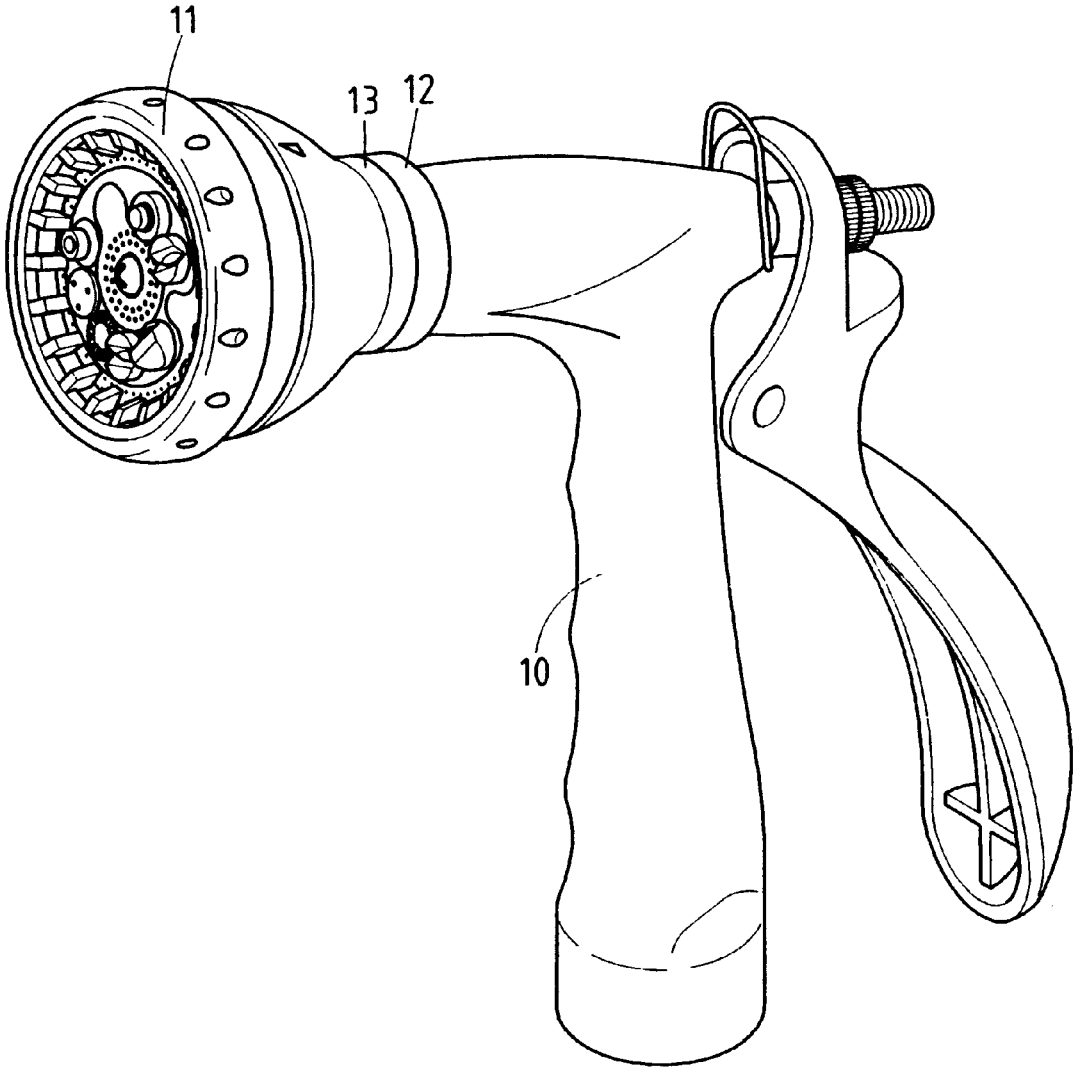
FIG. 1 shows a perspective view of the preferred embodiment of the present invention.
Figure 2:
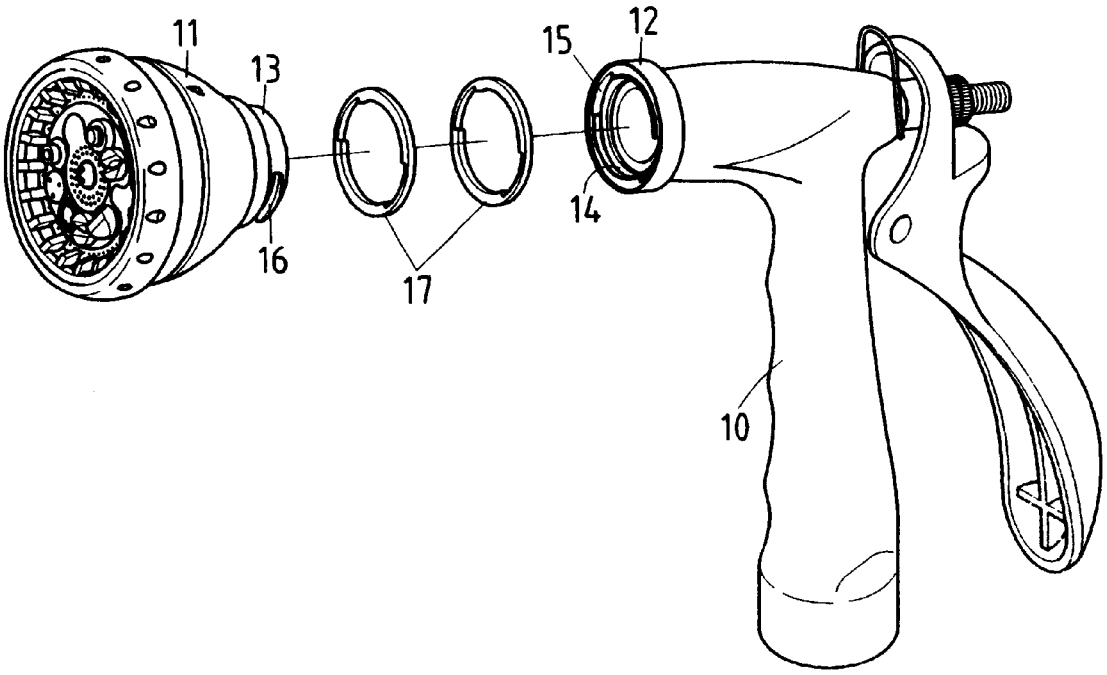
FIG. 2 shows an exploded view of the preferred embodiment of the present invention.
Figure 3:
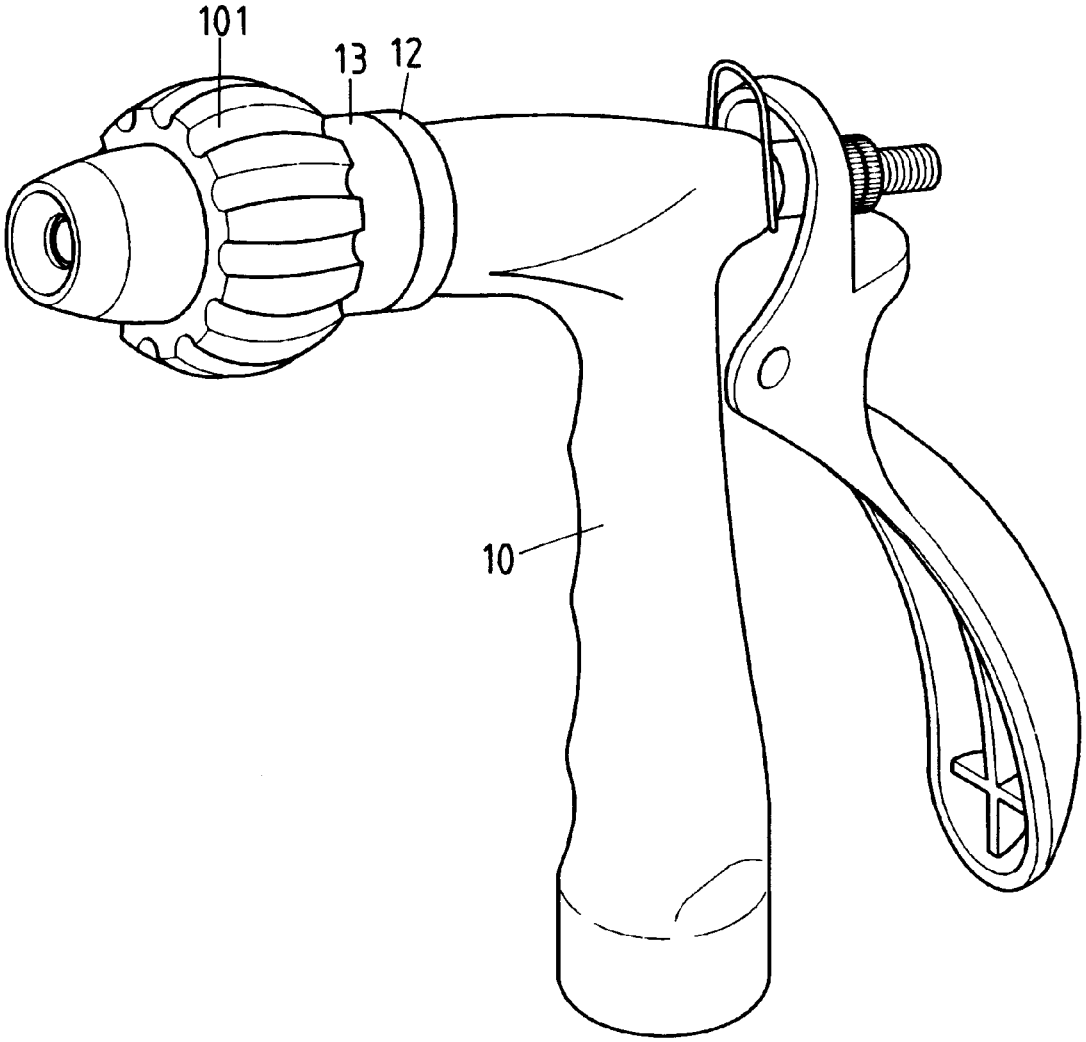
FIG. 3 shows another perspective view of the preferred embodiment of the present invention.
Figure 4:
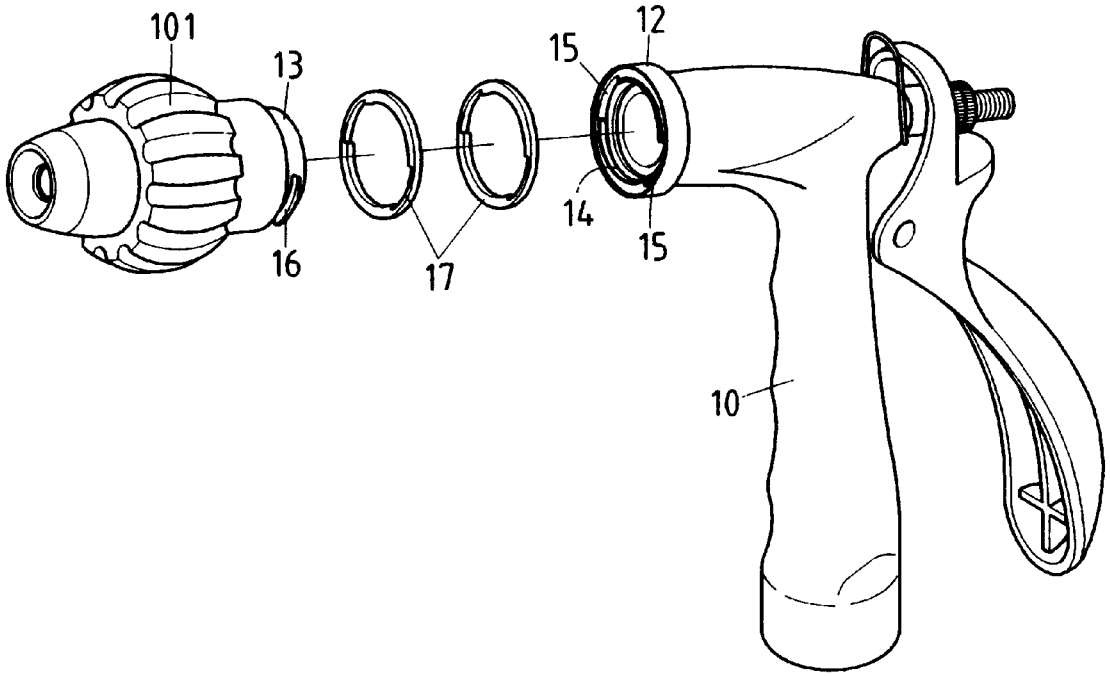
FIG. 4 shows another exploded view of the preferred embodiment of the present invention.
Figure 5:
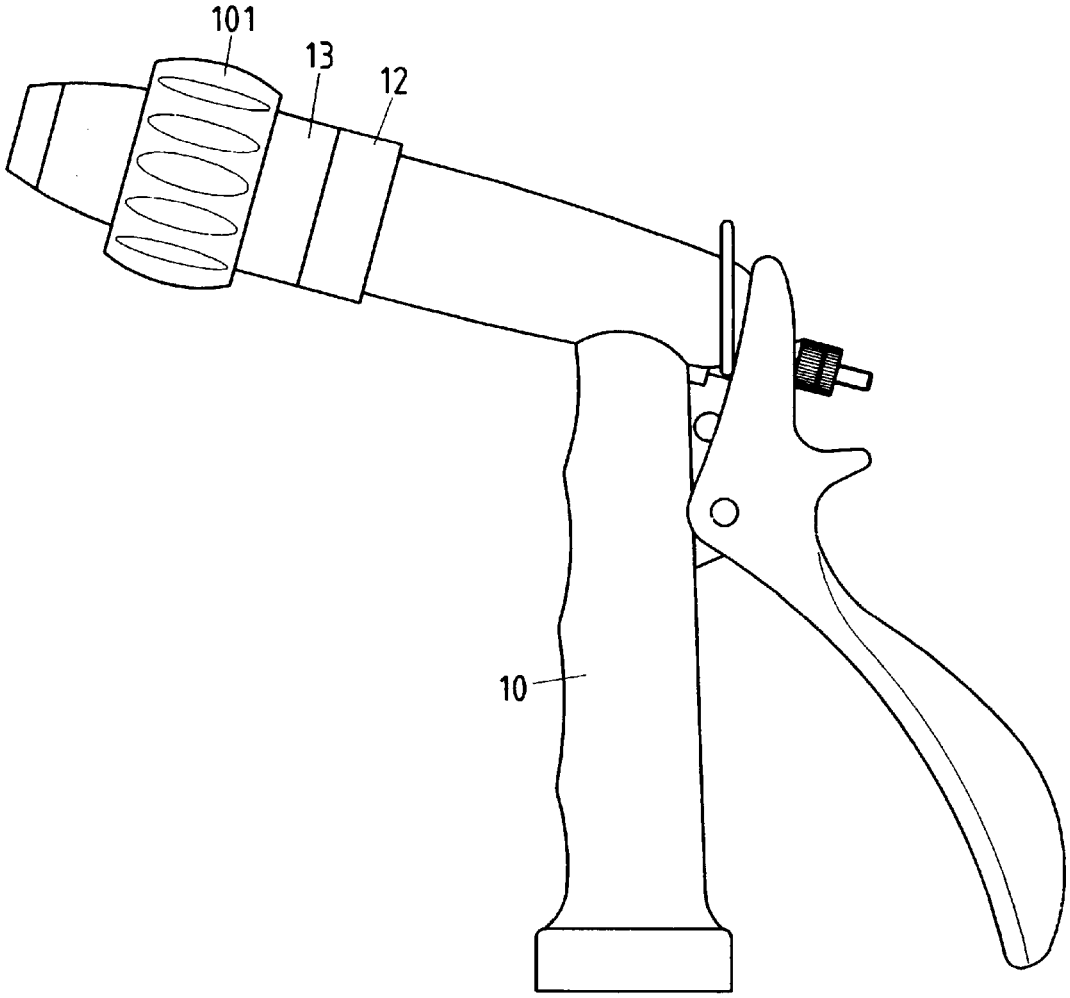
FIG. 5 shows a schematic plan view of the preferred embodiment of the present invention.
Figure 6:
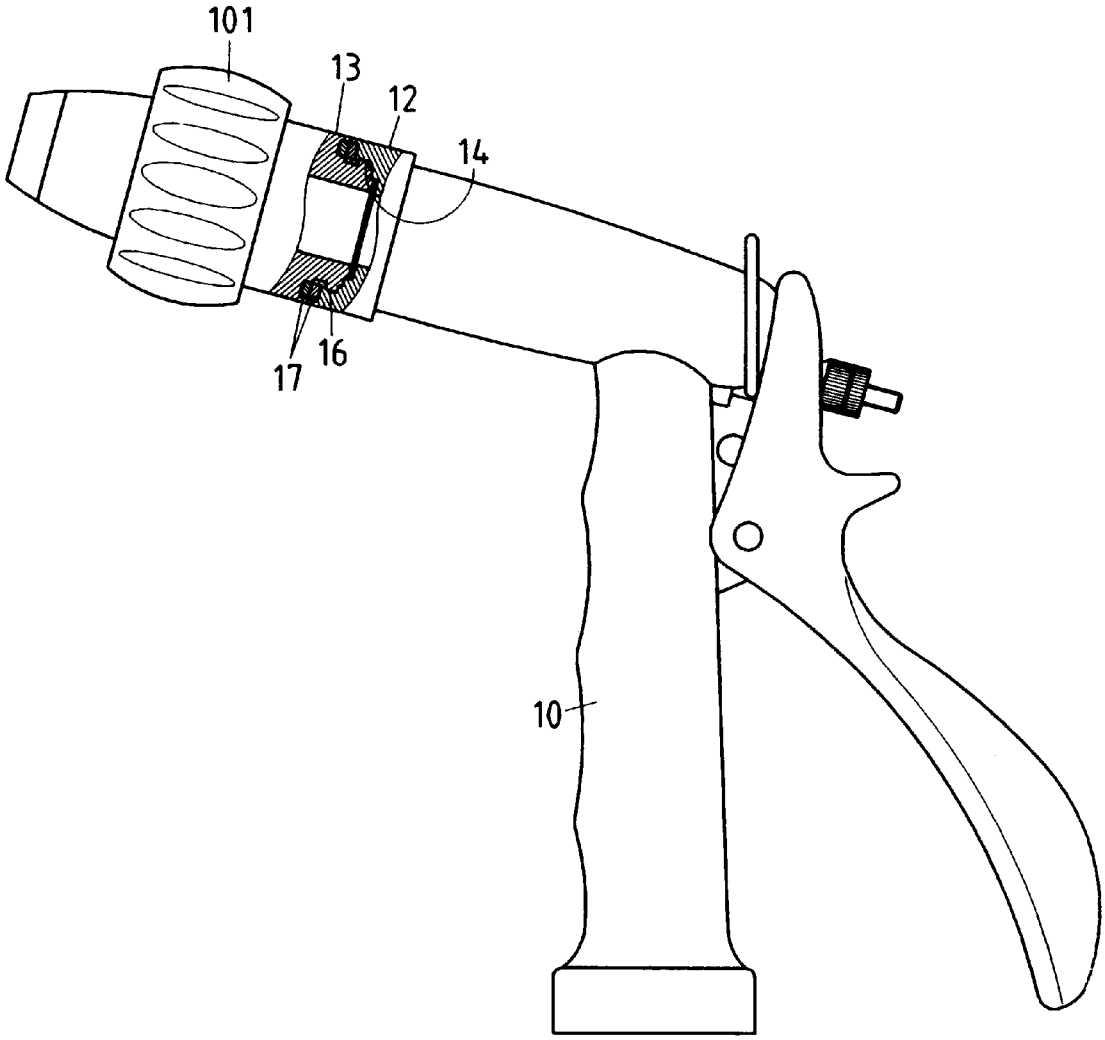
FIG. 6 shows a partial sectional view of the preferred embodiment of the present invention.
Figure 7:
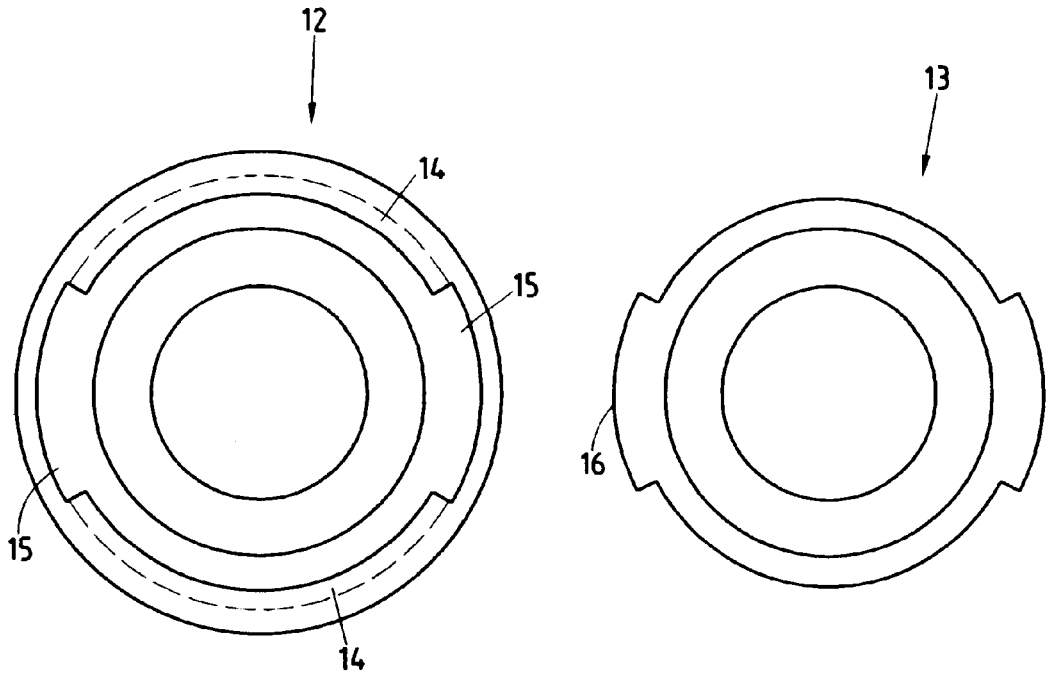
FIG. 7 shows a partial cross sectional view of the preferred embodiment of the present invention.
Figure 8A:
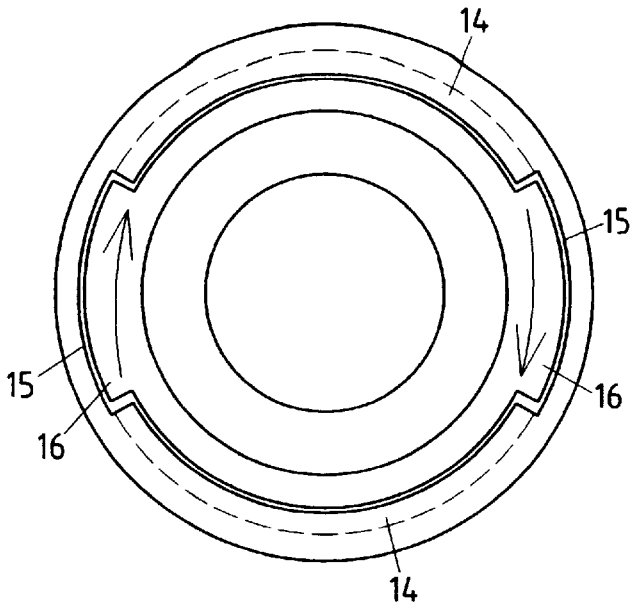
FIG. 8A shows a cross sectional view of the preferred embodiment of the present invention at work.
Figure 8B:
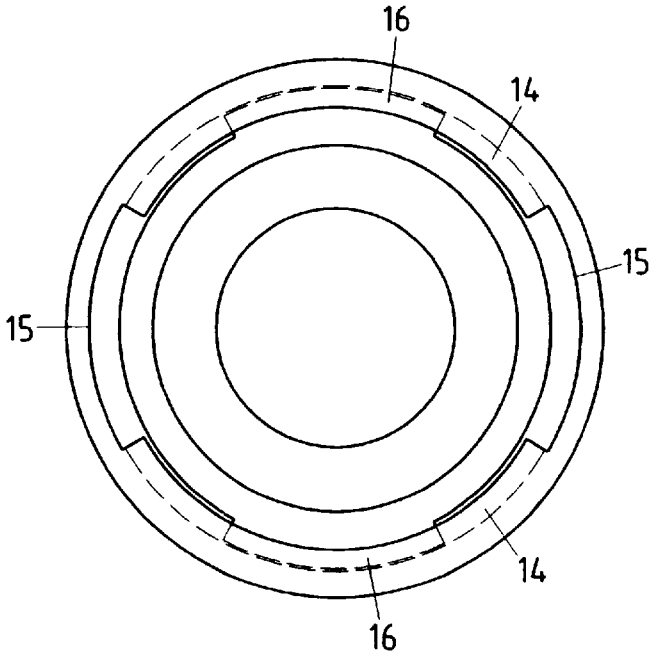
FIG. 8B shows another cross sectional view of the preferred embodiment of the present invention at work.

As shown in all drawings provided herewith, a water pistol nozzle of the preferred embodiment of the present invention comprises a handle 10, a first nozzle 11 and a second nozzle 101. The preferred embodiment of the present invention is characterized by the handle 10 which is provided at one end with a first engagement portion 12, and the nozzles 11 and 101 which are provided at one end with a second engagement portion 13.

The first engagement portion 12 of the handle 10 is provided with a retaining slot 14 and a guide opening 15. The second engagement portion 13 of the nozzles 11 and 101 is provided with a retaining protrusion 16 corresponding in location to and engageable with the retaining slot 14 of the first engagement portion 12 of the handle 10. The first and the second engagement portions 12 and 13 are provided with a washer 17. The nozzle 11 or 101 is detachably fastened with the handle 10 such that the retaining protrusion 16 of the nozzle 11 or 101 is received in the retaining slot 14 of the handle 10.

The nozzle 11 or 101 can be easily unfastened from the handle 10 by rotating the nozzle 11 or 101 such that the retaining protrusion 16 of the second engagement portion 13 of the nozzle 11 or 101 is disengaged with the retaining slot 14 of the first engagement portion 12 of the handle 10.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claim.

I claim:

1. A water sprayer comprising:

a handle having a circular opening at an end thereof, said circular opening having an interior wall, said handle having a retainer formed adjacent said end and extending radially inwardly from said interior wall, said retainer defining a retaining slot formed on a side of said retainer opposite said end of said handle, said retainer defining a guide opening extending from said end of said handle to said retaining slot, said handle having a washer affixed at said end against said retainer; and a nozzle detachably received by said handle, said nozzle having an annular end surface at an end thereof, said annular end surface having a protrusion extending radially outwardly therefrom, said protrusion received within said retaining slot, said protrusion having a length less than a length of said guide opening such that said protrusion can pass therethrough when said nozzle is attached to said handle, said nozzle having a washer affixed over said annular end surface on a side of said protrusion opposite said end of said nozzle, said washer of said handle being juxtaposed against said washer of said nozzle.

* * * * *